US007435189B2

(12) United States Patent
Hirano

(10) Patent No.: US 7,435,189 B2
(45) Date of Patent: Oct. 14, 2008

(54) IRON-TYPE GOLF CLUB HEAD

(75) Inventor: Tomoya Hirano, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 370 days.

(21) Appl. No.: 11/269,800

(22) Filed: Nov. 9, 2005

(65) Prior Publication Data

US 2006/0116219 A1 Jun. 1, 2006

(30) Foreign Application Priority Data

Dec. 1, 2004 (JP) ..... 2004-348838

(51) Int. Cl.
*A63B 53/04* (2006.01)

(52) U.S. Cl. ..... 473/342

(58) Field of Classification Search ..... 473/334, 473/335, 342, 349, 350

See application file for complete search history.

(56) References Cited

U.S. PATENT DOCUMENTS

2003/0078112 A1* 4/2003 Sugimoto ..... 473/342

FOREIGN PATENT DOCUMENTS

JP 7-148291 A 6/1995

* cited by examiner

*Primary Examiner*—Raeann Trimiew
(74) *Attorney, Agent, or Firm*—Birch, Stewart, Kolasch & Birch, LLP

(57) ABSTRACT

An iron-type golf club head comprises a top having an upper surface of the club head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising at least upper thin part provided between the top and the thick part, and the upper thin part having a width increasing from both sides of the toe and the heel toward therebetween.

14 Claims, 13 Drawing Sheets

IRON-TYPE GOLF CLUB HEAD

BACKGROUND OF THE INVENTION

1. Field of the Invention

The present invention relates to an iron-type golf club head capable of improving rebound performance without reducing durability.

2. Description of the Related Art

In order to improve the rebound performance of an iron-type golf club head, there has been a method in which the rigidity of the face portion is lowered by making the thickness thereof thin. However, the iron-type club head has some problems such as a lack of strength and a low durability of the face portion.

Accordingly, as illustrated in FIG. 13A and FIG. 13B corresponding to an enlarged end elevational view along a line Y-Y of FIG. 13A, there has been proposed an iron-type golf club head "a" with a face portion f including a thick part b provided in an approximately center portion and a thin part c provided around the thick part b and having a thickness smaller than the thin part b. The head "a" balances the durability and the rebound performance by increasing strength of the center portion of the face which is frequently brought into contact with a ball, and reducing the thickness around the center portion. However, the effect has not yet sufficient.

SUMMARY OF THE INVENTION

The present invention is made by taking the problem mentioned above into consideration, and a main object of the present invention is to provide an iron-type golf club head that improves the rebound performance without reducing durability.

In accordance with the present invention, an iron-type golf club head comprises a top having an upper surface of the club head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising at least upper thin part provided between the top and the thick part, and the upper thin part having a width increasing from both sides of the toe and the heel toward therebetween.

DESCRIPTION OF THE PREFERRED EMBODIMENTS

Embodiment of the present invention will now be described in detail in conjunction with the accompanying drawings.

Figure 1:
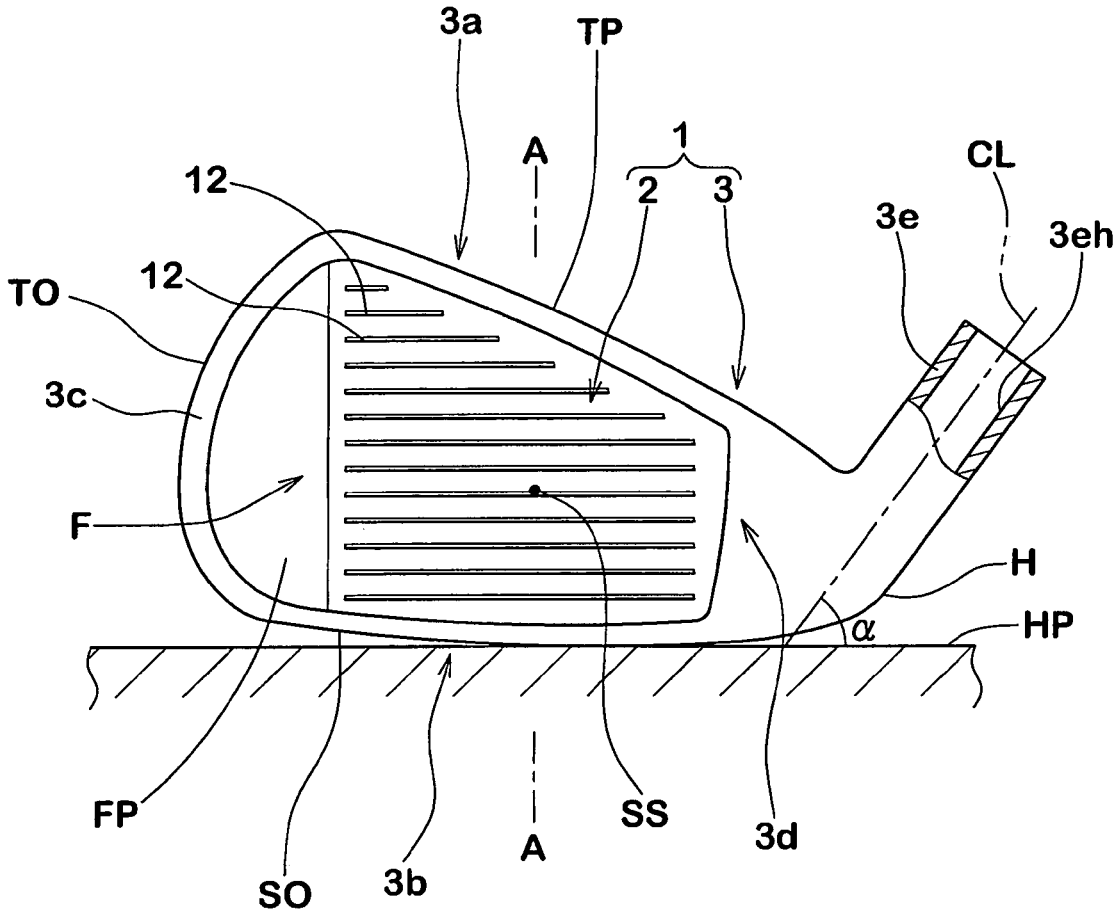
FIG. 1 is a front elevational view of an iron-type golf club head showing an embodiment of the present invention.
Figure 2:
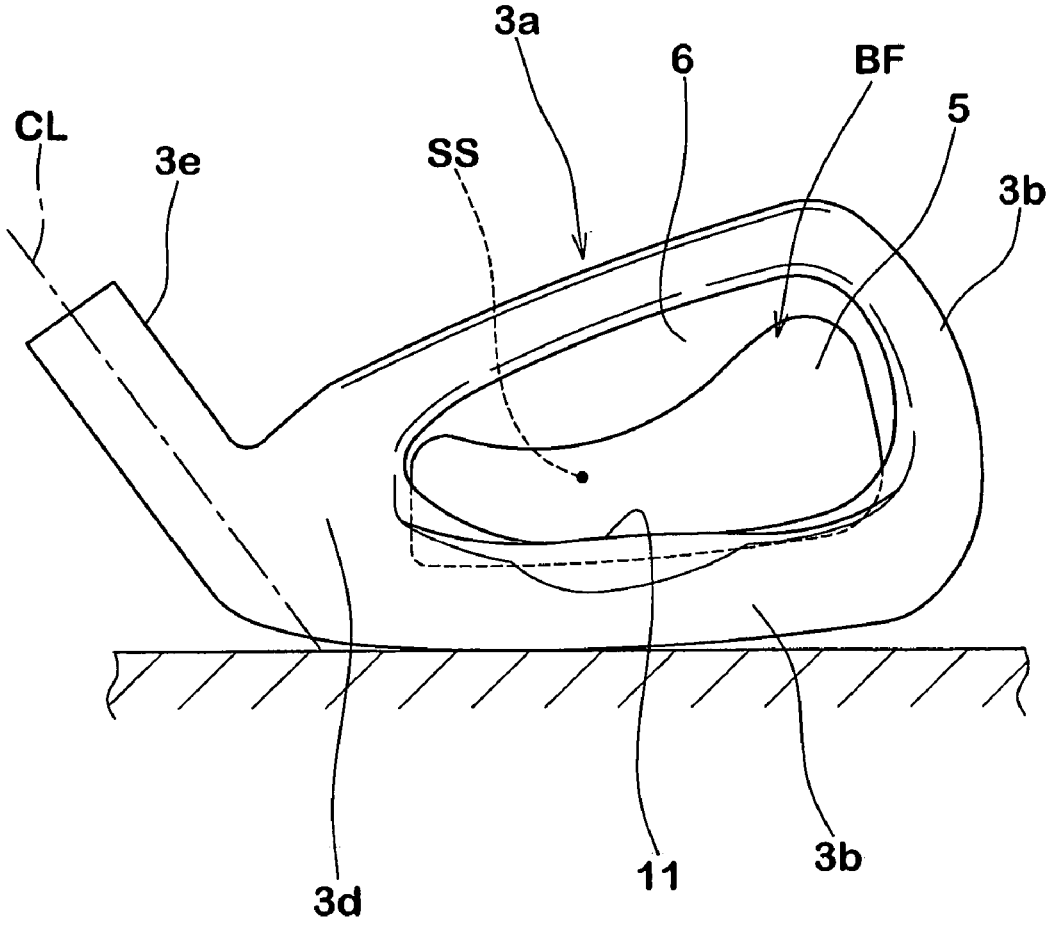
FIG. 2 is a back elevational view of the same.

FIG. 1 shows a standard state of an iron-type golf club head (hereinafter, refer simply to as "club head") 1 corresponding to an embodiment of the present invention. The standard state means a state in which the head 1 is grounded on a horizontal plate HP at a prescribed lie angle $\alpha$ and a loft angle $\beta$ (a real loft angle) defined in the head. The lie angle $\alpha$ is inclined on the basis of an axial center line CL of a shaft insertion hole 3*eh* mentioned below.

The club head comprises: a top TP with an upper surface of the club head 1; a sole SO with a bottom surface of the club head 1; a toe TO connecting the top TP and the sole SO; a heel H provided in the opposite side of the toe TO; and a face portion FP being surrounded by the top TP, the sole SO and the toe TO. The face portion FP comprises a front face defining a club face F for hitting a ball and a back face BF.

In this embodiment, the club head 1 comprises a face plate 2 with at least one part of the club face F and a main body 3 provided with a face mount portion 10 to which the face plate 2 is fitted.

The face plate 2 is formed into a plate shape and comprises a front surface 2A substantially flat, a back surface 2B and an annular circumferential surface e therebetween. There is a case that the front surface 2A is provided with a face line 12 extending horizontally in the standard state.

It is desirable that the face plate 2 is made, for example, of a titanium alloy (Ti-6Al-4V). However, the other metal materials may be used. For example, SUS450 (a maraging steel) or the like are also preferable.

Figure 4:
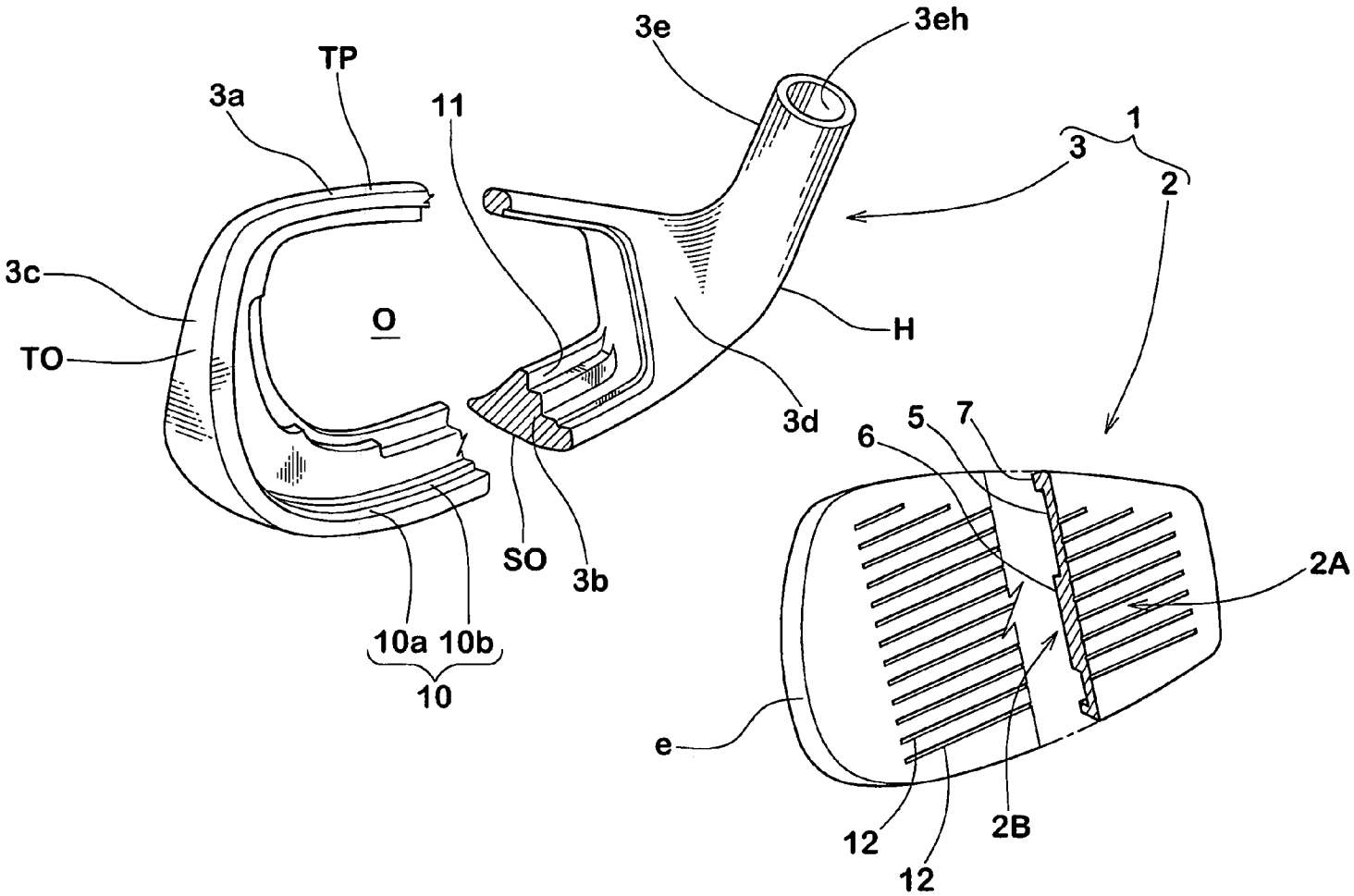
FIG. 4 is an exploded perspective view of a head.

As illustrated in FIG. 4, the main body 3 comprises a top rim portion 3*a* with the top TP, a sole rim portion 3*b* with the sole SO, a toe-side rim portion 3*c* connecting the top rim portion 3*a* and the sole rim portion 3*b* at the side of the toe TO, and a heel-side rim portion 3*d* connecting the top rim portion 3*a* and the sole rim portion 3*b* at the side of the heel H so as to form a stepped hole O. A hosel 3*e* with the insertion hole 3*eh* for inserting a club shaft is formed integrally with the heel-side rim portion 3*d*.

The face mount portion 10 in this embodiment is formed by the stepped hole O. The mount portion 10 comprises an annularly continuously extending circumferential wall 10*a* which provided support for the circumferential surface e of the face plate 2, and an annularly continuously back-support wall 10*b* which provided support for a periphery part of the back surface 2B of the face plate 2.

The circumferential wall 10*a* has substantially the same outline profile as that of the circumferential surface e of the face plate 2. Further, the circumferential wall 10*a* has substantially the same depth as a thickness of the circumferential surface e of the face plate 2. However, it goes without saying that these structures can be approximately changed.

Figure 3:
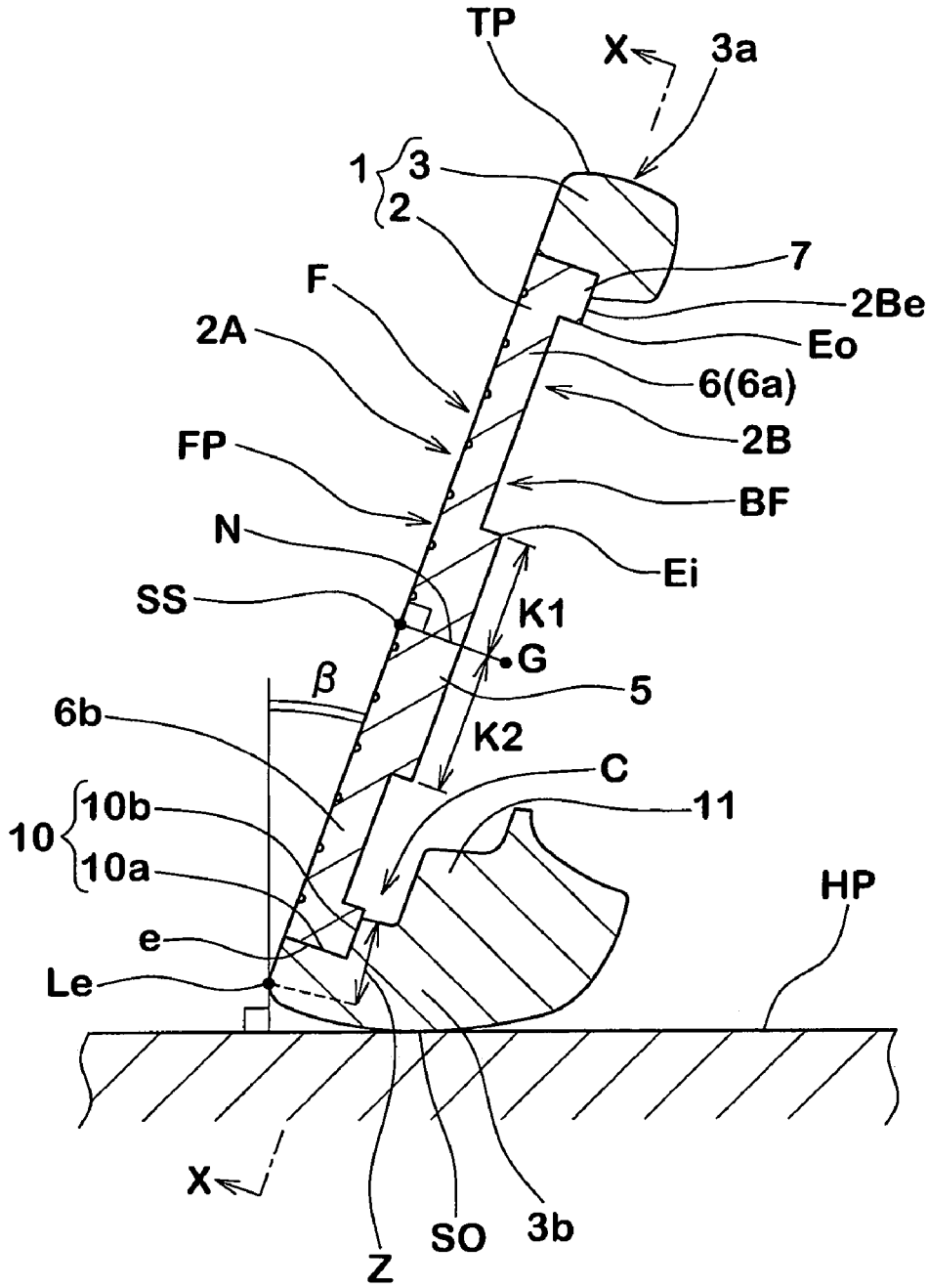
FIG. 3 is an end elevational view along a line A-A in FIG. 1.

Further, a back wall portion 11 is provided in a sole rim portion 3*b* of the main body 3. The back wall portion 11 is bent upward from the sole rim portion 3*b* leaving a space from the back surface 2B of the face plate 2, as shown in FIG. 3. The back wall portion 11 allocates more weight to a rear side of the club head 1, and serves for setting a center of gravity of the club head 1 deeper.

The main body 3 is not particularly limited, but is desirably structured by a metal material having a comparatively large specific gravity. For example, a stainless steel such as SUS630, SUS255 or SUS450 is preferably employed.

Figure 5:
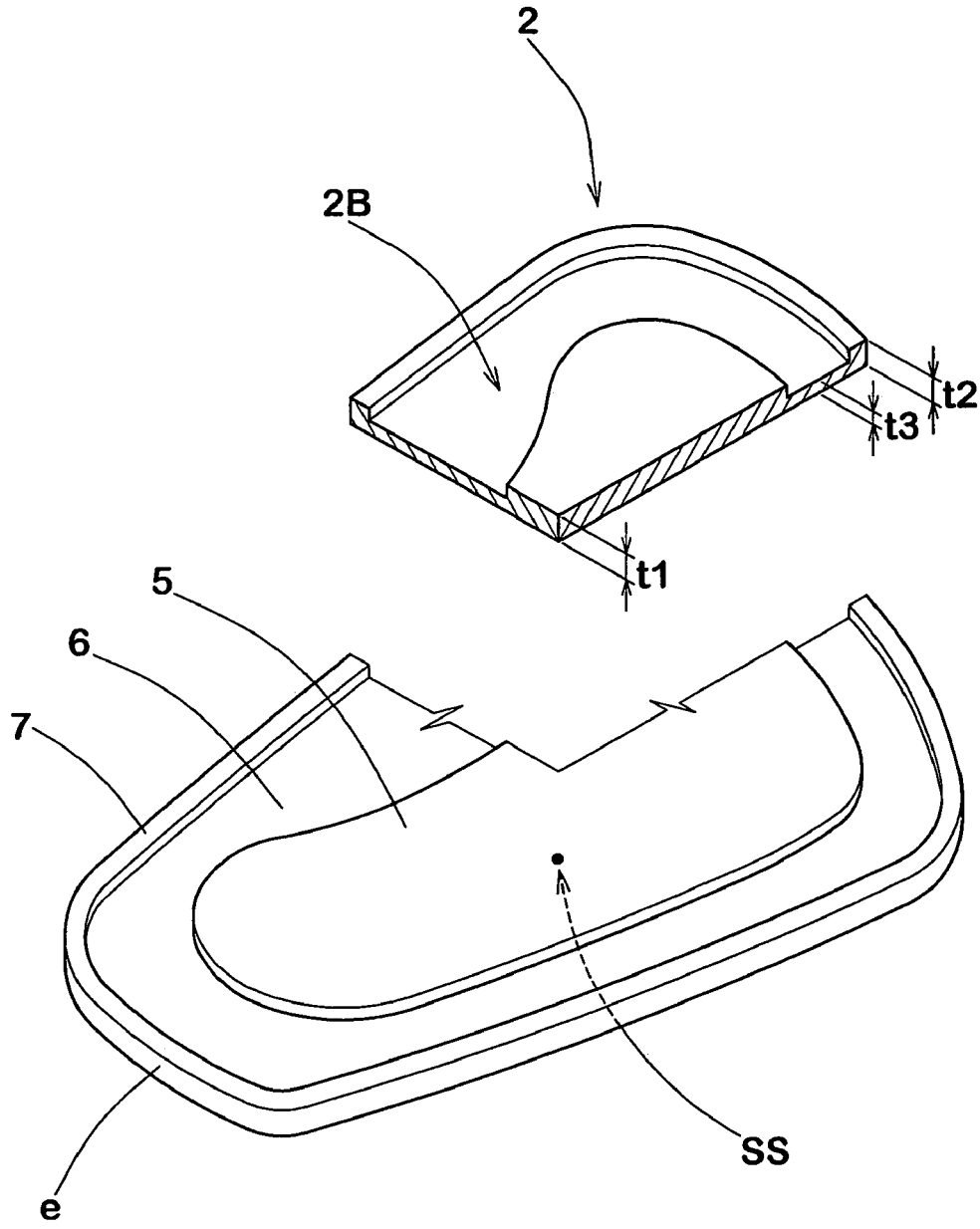
FIG. 5 is a perspective view of a face plate as seen from a back face side.

FIG. 5 shows a perspective view in the case of seeing the face plate 2 from the back surface 2B. The face plate 2 of the present embodiment is provided with a thick part 5 forming an area including a sweet spot SS of the club head 1, a thin part 6 provided around the thick part 5 and having a smaller thickness than the thick part 5, and an outer thick part 7 provided in an outer side of the thin part 6 and having a thickness larger than the thin part 6. The sweet spot SS corresponds to a point where a normal line N put down to the club face F from the center of gravity G of the club head 1 intersects the club face F, as shown in FIG. 3.

The area of the thick part 5 is frequently brought into contact with the golf ball. Accordingly, in order to secure a sufficient strength, it is desirable that a thickness t1 of the thick part 5 is not less than 2.5 mm, and more preferably not less than 2.7 mm. At the same time, in order to improve the rebound performance, it is desirable that the thickness t1 is not more than 3.5 mm, and more preferably not more than 3.2 mm. In the present embodiment, the thick part 5 is formed substantially at a fixed thickness except at the face lines 12.

Further, taking the attaching strength to the face mount portion 10 and the rebound performance of the club head 1 into consideration, it is desirable that the thickness t2 of the outer thick part 7 is set to substantially the same range as the thickness t1 of the thick part 5.

Further, in order to lower the rigidity of the face plate 2 so as to improve the rebound performance of the club head 1, it is desirable that the thickness t3 of the thin part 6 is not more than 2.3 mm, and more preferably not more than 2.0 mm. At the same time, in order to maintain the durability of the face plate 2, it is desirable that the thickness t3 mentioned above is not less than 1.6 mm, and more preferably not less than 1.7 mm. Above all, it is desirable that the thickness t3 of the thin part 6 is not less than 30% of the thickness t1 of the thick part 5, more preferably not less than 50% thereof, and particularly preferably not less than 60% thereof, and it is desirable that it is nor more than 90% thereof, more preferably not more than 80% thereof, and particularly preferably not more than 70% thereof.

The club head 1 of the present embodiment comprises such that the face plate 2 is integrally attached to the main body 3, for example, by caulking, adhesion, or other bonding means. Further, the face portion FP and the club face F are formed by attaching the face plate 2 and the main body 3.

Figure 6:
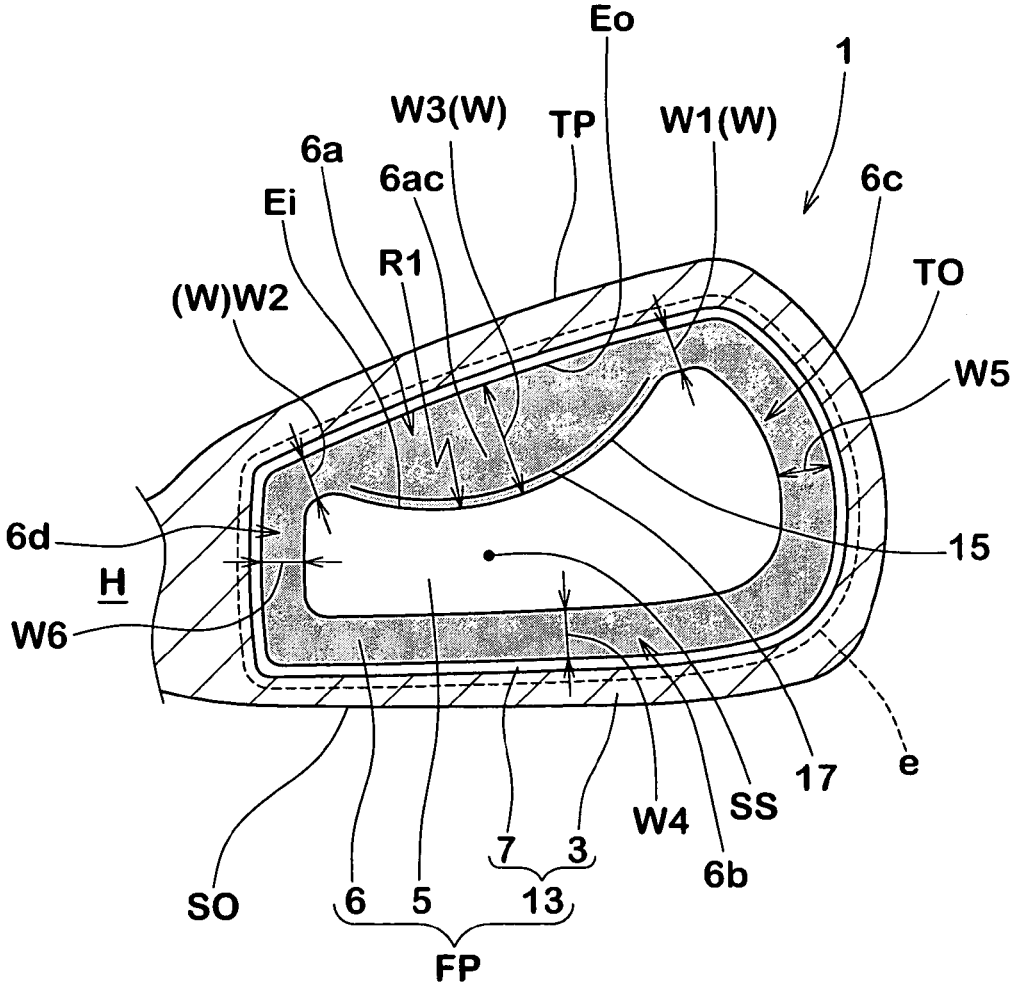
FIG. 6 is a cross sectional view along a line X-X in FIG. 3.

FIG. 6 shows a cross sectional view along a line X-X in FIG. 3. In this case, the cross section along the line X-X corresponds to a plane obtained by virtually extending a back surface of the thick part 5. The face portion FP of the club head 1 includes the thick part 5 forming the area having the sweet spot SS, and the thin part 6 provided around the thick part 5 with the thickness t3 smaller than the thickness t1 of the thick part 5.

The thin part 6 of the present embodiment is formed in an annular groove shape and comprises an upper thin part 6*a* provided between the thick part 5 and the top TP and extending along a toe-heel direction, a lower thin part 6*b* provided between the sole SO and the thick part 5 and extending along the toe-heel direction, a toe-side thin part 6*c* connecting between the lower thin part 6*b* and the upper thin part 6*a* in the toe side, and a heel-side thin part 6*d* connecting between the lower thin part 6*b* and the upper thin part 6*a* in the heel side. Thus, the thick part 5 is continuously surrounded by the thin part 6.

An outer frame portion 13 with a thickness equal to or more than the thickness t1 of the thick part 6 is continuously provided at an outer side of the thin part 6. The outer frame portion 13 comprises the outer thick part 7 of the face plate 2 and the rim portions 3*a*, 3*b*, 3*c* and 3*d* of the main body 3.

The thin part 6 has an outer edge Eo extending along an outer side of the club head 1, and an inner edge Ei extending along the thick part 5. Further, a width w between the outer edge Eo and the inner edge Ei at an optional position of each of the thin parts 6 is measured as a shortest distance from an optional position on the inner edge Ei to the outer edge Eo. Further, the width W is measured in a direction along the club face F.

Figure 13A:
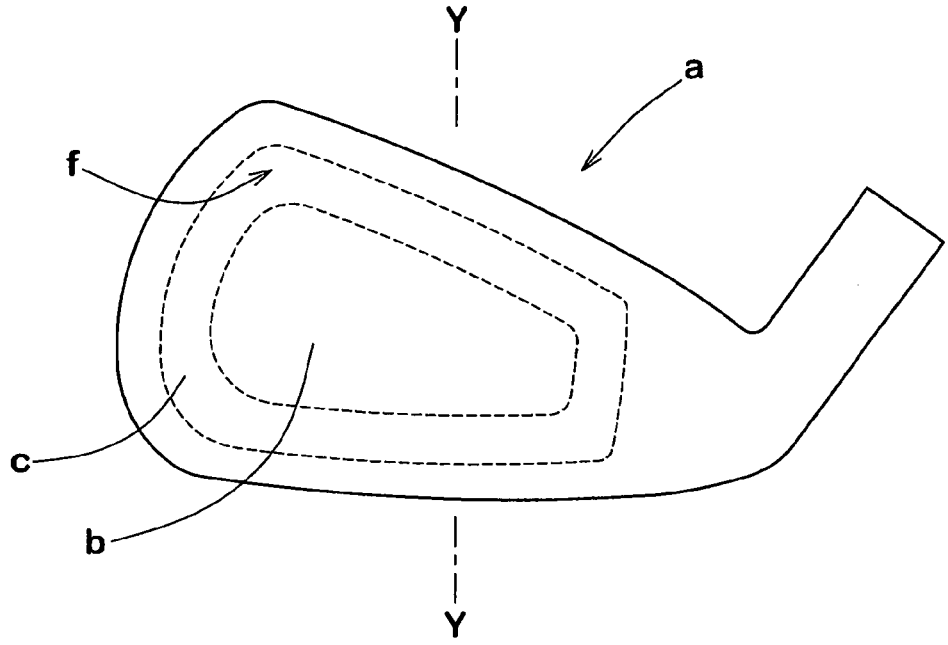
FIG. 13A is a front elevational view of a conventional head.
Figure 13B:
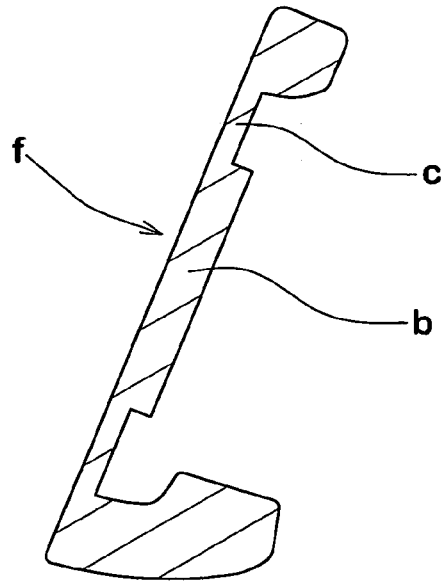
FIG. 13B is an end elevational view along a line Y-Y in FIG. 13A.

In the club head 1 of the present embodiment, the upper thin part 6*a* has the width smoothly increasing from the toe side and the heel side toward an intermediate portion 6*ac* therebetween. In the conventional club head with a circumferential thin structure in the club face as shown in FIG. 13, a width of the upper thin part is substantially fixed. Accordingly, if the width of the thin part 6 is increased, a significant reduction of the durability of the face plate 2 is generated. On the contrary, if the width of the thin part 6 is made small, the rebound performance is deteriorated.

On the other hand, according to the present invention, the width w of the upper thin part 6*a* is relative, and set to become smaller toward the toe-heel direction and larger in the intermediate portion 6*ac*. Accordingly, it is possible to enlarge the thin part 6 to a portion near the sweet spot SS. Since the sweet spot SS generally corresponds to a hit point which can carry the ball to the farthest, it is possible to effectively increase the rebound performance by making the rigidity near the same small. Therefore, it is possible to increase the carry of the hit ball.

In this case, the "intermediate portion" of the upper thin part 6*a* means a position or a portion for enlarging the thin part 6 to the portion near the sweet spot SS, and is not limited to a strict intermediate position between the toe TO and heel H.

Further, the iron-type golf club head 1 is most commonly used when hitting the golf ball placed on the grass. As a result, there is a tendency that the ball is hit actually at positions which are lower than the sweet spot SS. In other words, relatively, it is not very often that the ball is hit on the top TP side from the sweet spot SS. Accordingly, even if the width of the intermediate portion 6*ac* of the upper thin part 6*a* is made large, and the thin part 6*a* is widened to the portion near the sweet spot SS, the durability of the club head 1 can be sufficiently maintained. Further, each of the widths in the toe side and the heel side of the upper thin part 6*a* is set to be relatively smaller in comparison with the intermediate portion 6*ac*. Therefore, it is possible to prevent a lack of strength in the face portion FP as a whole. As mentioned above, the club head 1 of the present invention can achieve both of the rebound performance and the durability in a higher dimension.

In order to further improve the rebound performance and the durability, it is desirable that a smallest width W1 in the toe side of the upper thin part 6*a* and a smallest width W2 in the heel side are not less than 2 mm, more preferably not less than 3 mm, and particularly preferably not less than 4 mm, and it is desirable that the widths W1 and W2 are not more than 10 mm, more preferably not more than 8 mm, and further preferably not more than 6 mm.

Further, in order to further improve the rebound performance and the durability, it is desirable that a largest width W3 of the intermediate portion 6*ac* of the upper thin part 6*a* is not less than 4 mm, more preferably not less than 6 mm, and particularly preferably not less than 8 mm, and it is desirable that an upper limit thereof is not more than 20 mm, more preferably not more than 14 mm, and particularly preferably not more than 12 mm.

Further, in order to further improve the rebound performance and the durability, it is desirable that a ratio (W3/W1) and/or a ratio (W3/W2) of the respective widths are not less than 1.50, more preferably not less than 1.75, and particularly preferably not less than 2.0, and it is desirable that an upper limit thereof is not more than 3.0, and more preferably not more than 2.50.

In order to effectively reduce the rigidity near the sweet spot SS, as shown in FIG. 3, in a vertical cross section of the club head 1 passing through the sweet spot SS and being perpendicular to the club face F, it is desirable that a distance K1 between the sweet spot SS and the inner edge Ei of the upper thin part 6*a* is not less than 5 mm, and more preferably not less than 7 mm, and it is desirable that an upper limit thereof is not more than 15 mm, and more preferably not more than 12 mm.

Further, in the vertical cross section mentioned above, it is desirable that a distance K2 between the sweet spot SS and the inner edge Ei of the lower thin part 6*b* is larger than the distance K1 mentioned above. Accordingly, since a lower portion of the sweet spot SS forms a position for actually hitting the ball more, it is possible to further improve the durability by making the distance K2 relatively larger in comparison with the distance K1. From this point of view, it is desirable that the distance K2 is not less than 5 mm, more preferably not less than 7 mm, and particularly preferably not less than 10 mm, and it is desirable that an upper limit thereof is not more than 20 mm, more preferably not more than 15 mm, and further preferably not more than 12 mm.

Further, a specific shape of the upper thin part 6*a* is not particularly limited as an aspect shown in Figs.

The upper thin part 6*a* of the present embodiment comprises the outer edge Eo extending approximately in parallel to the top TP and the inner edge Ei formed a curve which protruding toward the sole SO. It is desirable that the curve include at least one arc 15.

A radius of curvature R1 of the arc 15 mentioned above is preferably not less than 15 mm, more preferably not less than 25 mm, and further preferably not less than 40 mm, and it is desirable that an upper limit thereof is not more than 150 mm, more preferably not more than 120 mm, and further preferably not more than 100 mm. The arc line 15 mentioned above smoothly changes the rigidity in the top side of the face portion FP along the toe-heel direction. Accordingly, it is possible to prevent a stress concentration in a specific portion of the upper thin part 6*a*.

Figure 7A:
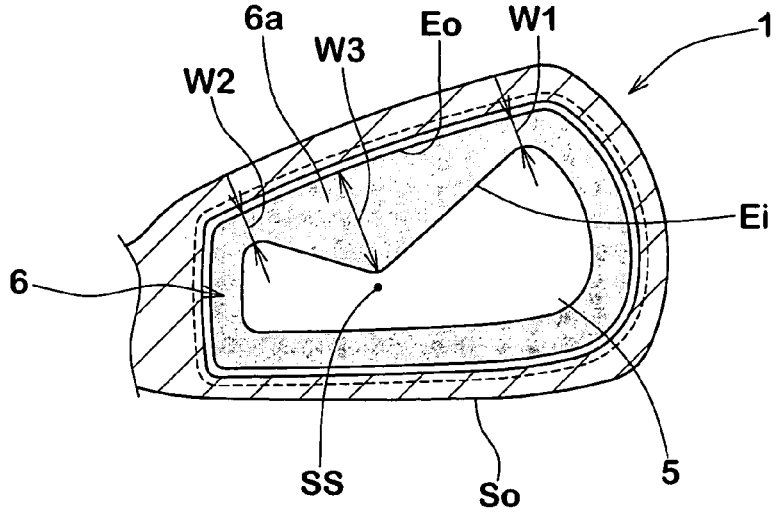
FIGS. 7A to 7C are cross sectional views along a line X-X in FIG. 3, showing another embodiment of the present invention.

The upper thin part 6*a* further comprises an aspect which has the inner edge Ei including a curve protruding in a V shape toward the sole SO as shown in FIG. 7A.

Figure 7B:
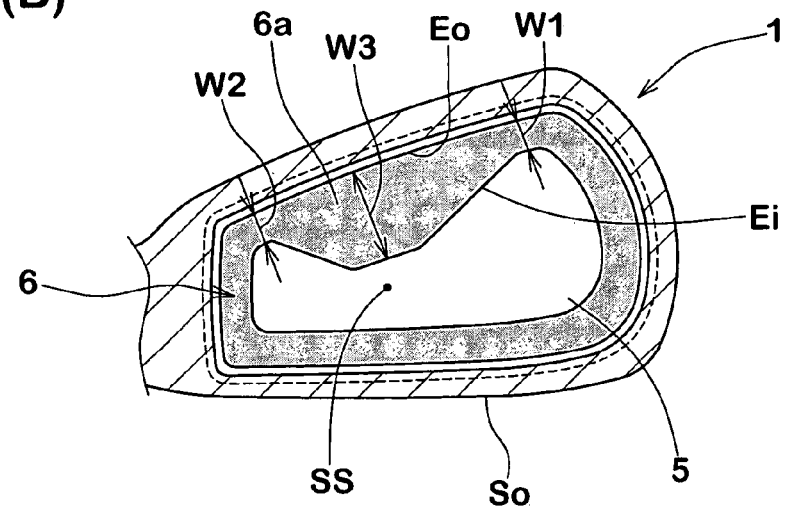

The upper thin part 6*a* further comprises an aspect which has the inner edge Ei including a curve protruding in a trapezoidal shape toward the sole SO as shown in FIG. 7B.

Figure 7C:
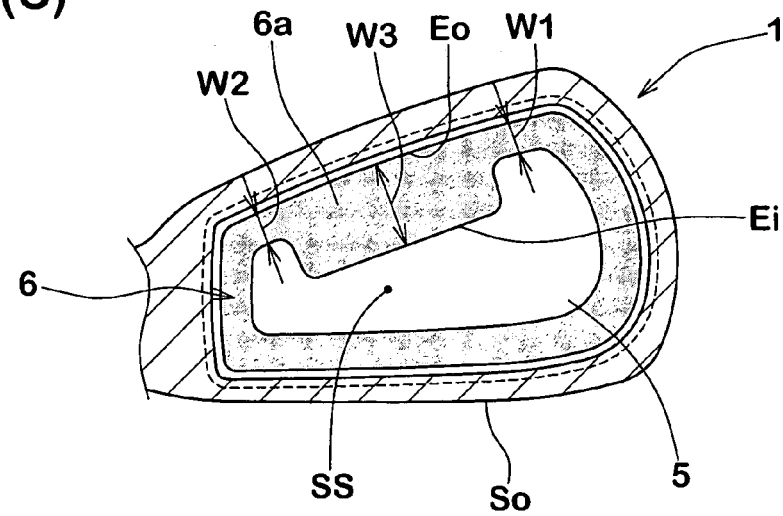

Also the upper thin part 6*a* further comprises an aspect has the inner edge Ei including a curve protruding in a rectangular shape toward the sole SO as shown in FIG. 7C.

Further, in the present embodiment, widths W4, W5 and W6 of the lower thin part 6*b*, the toe-side thin part 6*c* and the heel-side thin part 6*d*, respectively, are substantially formed fixed. Further, in order to improve the durability and the rebound performance, it is desirable that the widths W4, W5 and W6 are not less than 3 mm, and more preferably not less than 4 mm, and it is desirable that the upper limits thereof are not more than 7 mm, and more preferably not more than 6 mm. It is not always necessary that the thin part 6 is continuously formed annular as in the present embodiment, but the thin part 6 may be formed so as to be partly cut.

Further, the club head 1 of the present embodiment is provided with at least one narrow groove 17 (one in the present embodiment) extending along the inner edge Ei near the inner edge Ei, in the upper thin part 6*a* in the back surface 2B of the face plate 2. The narrow groove 17 damps quickly the vibration of the face portion FP generated at a time of hitting the ball, and improves a hitting feeling.

Figure 8:
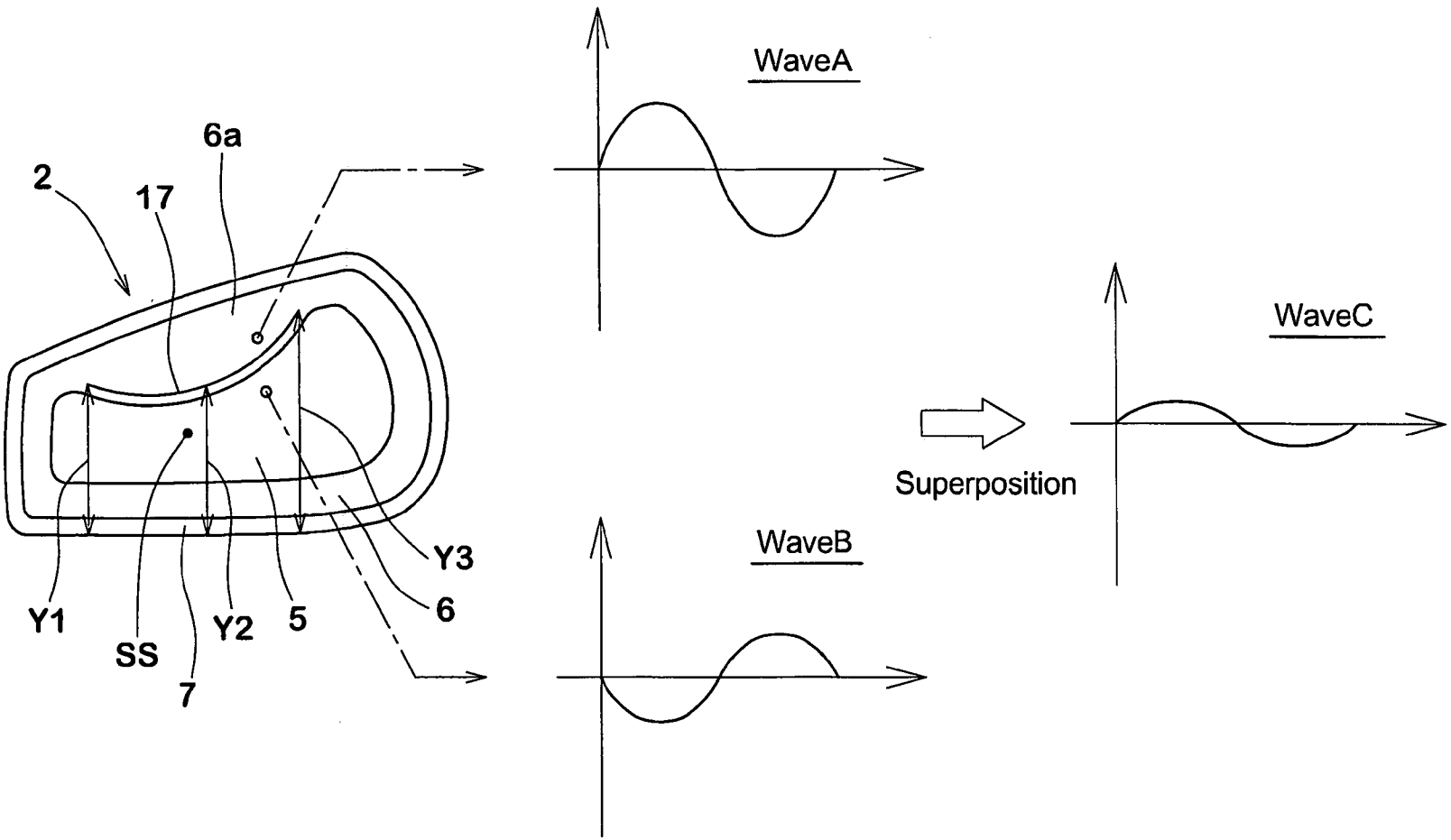
FIG. 8 is a graph showing a wave of a vibration of the face plate of the present invention.

FIG. 8 shows a back elevational view of the face plate 2. In the case that the narrow groove 17 is provided in the upper thin part 6*a*, a phase reversal on the basis of a half cycle displacement is generated in a vibration wave form in an upper side of the narrow groove 17 (shown as a wave "A") and a vibration wave form in a lower side (shown as a wave B) that are generated just after hitting the ball. Since a superposition principle is applied to the vibration wave, a wave C obtained by superposing the wave "A" and the wave B having the different phases has a small vibration amplitude and a small vibration energy. Accordingly, the vibration of the face plate FP at a time of hitting the ball is quickly absorbed and reduced, and an improved the hitting feeling is applied to the golfer.

The operation is significantly generated at a time when the narrow groove 17 extends along the inner edge Ei of the upper thin part 6*a*. Accordingly, it is particularly preferable that the narrow groove 17 is curved so as to be convex toward the sole SO side along the arc 15 drawn by the inner edge Ei of the upper thin part 6*a*. In the case that the narrow groove 17 is formed in a linear shape which does not extend along the inner edge Ei, as shown in FIG. 11E, the effect mentioned above becomes small.

Further, in order to further improve the effect mentioned above, it is desirable that a groove width of the narrow groove 17 is not less than 0.25 mm, and more preferably not less than 0.35 mm, but it is preferably not more than 0.75 mm, and more preferably not more than 0.65 mm. In the same manner, it is desirable that a groove depth of the narrow groove 17 is not less than 0.10 mm, more preferably not less than 0.25 mm, and an upper limit thereof is preferably not more than 0.40 mm. If the groove width and/or the groove depth of the narrow groove 17 is too small, it is hard to sufficiently obtain the effect mentioned above, and an improvement of the hitting feeling can not be sufficiently expected by extension. On the contrary, if the groove width and/or the groove depth become large, there is a tendency that the stress concentration is generated in the bottom of the narrow groove 17.

The groove width and/or the groove depth of the narrow groove 17 may be fixed over an entire groove length, or may be appropriately changed. Although not illustrated in the drawing, a cross sectional shape of the narrow groove 17 is preferably formed in a semicircular shape or a circular shape in the groove bottom in view of avoiding the stress concentration.

Further, it is desirable that a distance between the narrow groove 17 and the inner edge Ei is not less than 0.5 mm, more preferably not less than 1 mm, and it is desirable that an upper limit thereof is not more than 2 mm, and more preferably not more than 1.5 mm. If the distance mentioned above is too large, the effect of damping the vibration at a time of hitting the ball becomes small. On the contrary, if the distance mentioned above is too small, the durability tends to be lowered.

In the same manner, if the length of the narrow groove 17 is too small, it is impossible to sufficiently improve the hitting feeling. On the contrary, if it is too large, the rigidity of the face plate 2 tends to be lowered. From this point of view, it is desirable that the length of the narrow groove 17 is not less than 20 mm, and more preferably not less than 25 mm, and it is desirable that it is not more than 50 mm, and more preferably not more than 45 mm. In this case, the length of the narrow groove 17 is set to a so-called path length measured along it.

Figure 9:
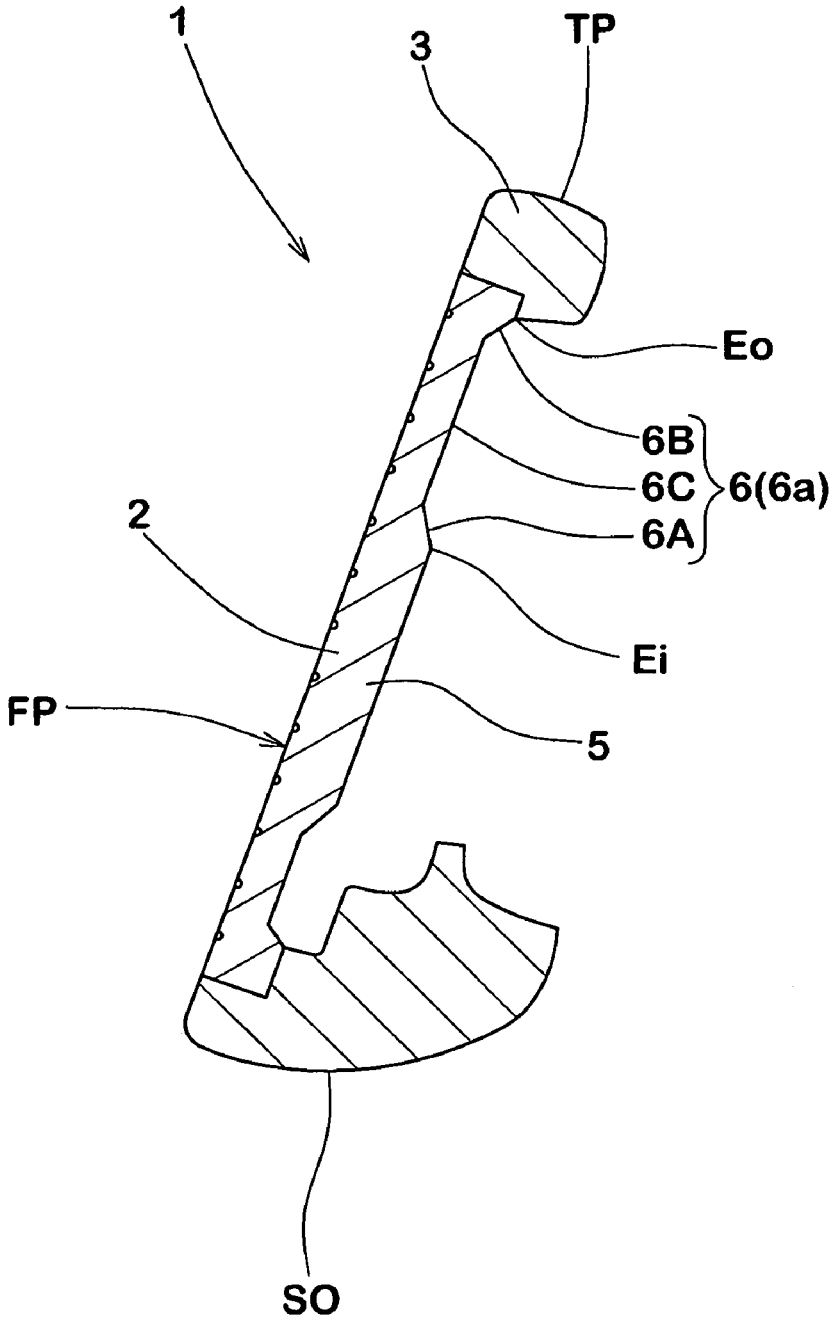
FIG. 9 is a cross sectional view of a head, showing another embodiment of the present invention.

FIG. 9 shows another embodiment of the present invention. The thin part 6 of the club head 1 comprises an inner gradually reducing portion 6A in which the thickness thereof is gradually reduced from the inner edge Ei, and an outer gradually reducing portion 6B in which the thickness thereof is gradually reduced from the outer edge Eo of the thin part 6. For example, a fixed thickness portion 6C having substantially a fixed thickness or the like is provided between the inner gradually reducing portion 6A and the outer gradually reducing portion 6B. As mentioned above, the thin part 6 may be structured such that the thickness is changed smoothly or step by step. In particular, the club head 1 of this embodiment mentioned above smoothens the change of the rigidity between the thick part 5 and the thin part 6, and serves for improving the durability of the face portion FP.

Figure 10:
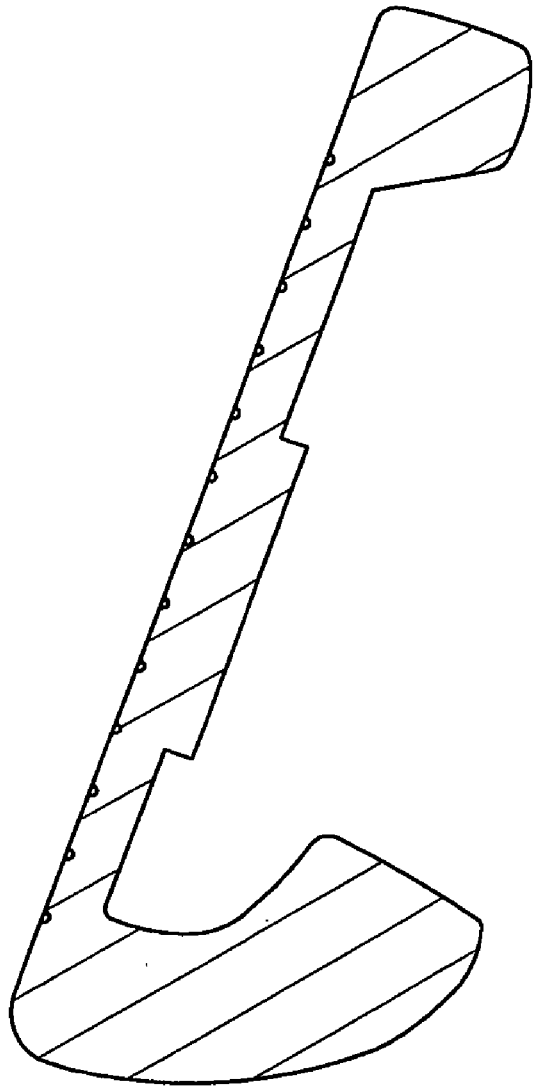
FIG. 10 is a cross sectional view of a head, showing another embodiment of the present invention.

FIG. 10 shows yet another embodiment of the present invention. The club head 1 of this embodiment is shown as a structure of being integrally formed of one material by, for example, forging, casting or the like. The head mentioned above is excellent in a productivity.

Comparison Test

Iron-type golf club heads (#5, loft angle 24 degrees) with the basic structure shown in FIG. 4 were manufactured by way of trial, and various tests were executed. In order to evaluate the performance, the shape of the upper thin part was variously changed on the basis of the specification in Table 1 and FIGS. 11(A) to 11(E). Further, each of the heads was manufactured by pressing the face plate made of Ti-6Al-4v into the main body constituted by a lost wax casting of SUS630, and caulking a part of the main body so as to integrally bond.

Further, in the face portion, the thickness of the thick part was unified to 3.0 mm, the thickness of the thin part was unified to 2.0 mm. Further, in the thin part, each of the widths of the lower thin part, the toe-side thin part and the heel-side thin part was substantially fixed to 2.0 mm. Further, with respect to the structure having the narrow groove in the back surface of the face plate, a narrow groove having a width of 0.50 mm and a depth of 0.30 mm was formed using a numerical control process. The test method is as follows.

Rebound Performance Test:

According to the "Procedure for Measuring the velocity Ratio of a Club Head for conformance to Rule 4-1e, Appendix II, Revision 2 (Feb. 8, 1999), United states Golf Association", the restitution coeficient (e) of each club head was obtained. The larger numerical value is better.

Durability Test:

A plurality of iron-type golf clubs with a length of 38 inch were manufactured by attaching the same carbon shafts (MP-300 FLEX R manufactured by SRI sports Limited.) to each of the club heads, and 3000 times ball hitting tests were performed in all the clubs by using a swing robot. Then an amount of depression on the face portion of ach club head was measured. The hitting conditions and the like are as follows.

Head speed: 40 m/s

Golf ball: "XXIO" manufactured by SRI sports Limited.

Taking the practical durability into consideration, a depressing amount less than 0.1 mm is acceptable.

Figure 12:
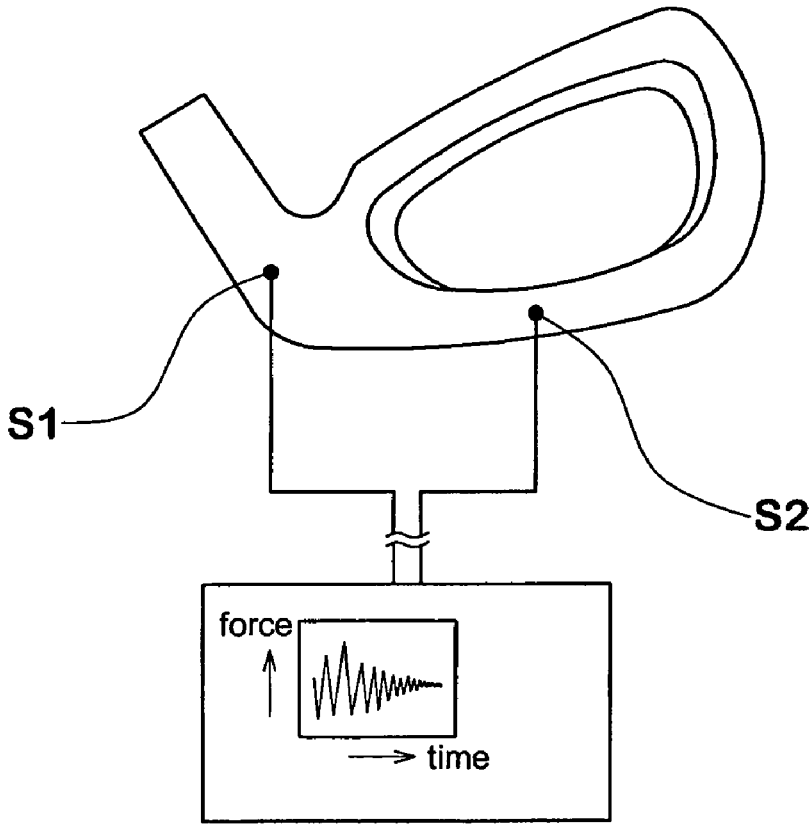
FIG. 12 is a schematic view exemplifying a test method of measuring an impact force at a time of hitting a ball.

Impact Force at Time of Hitting Ball:

As shown in FIG. 12, impact force sensors S1 and S2 were attached respectively to the heel portion and the sole portion of each of the test club heads, and the golf ball at a speed of 34.5 m/s is collided with the sweet spot of the freely supported head, whereby a maximum impact force (kgf) at that time was measured. The smaller the numerical value is, the more the vibration at a time of hitting the ball is absorbed. In this case, a specific frequency of the golf ball was 900 Hz.

Hitting Feeling:

The feeling at a time of hitting the ball was evaluated on the basis of the feeling of each of the golfers in accordance with a 1 to 5 scale when golfers with handicaps between 10 and 20 hits every twenty balls on the natural grass using each test club. Results were evaluated on the basis of an average of all the golfers. The larger the numerical value is, the better the feeling is. The results of the test and the like are shown in Table 1.

TABLE 1

Figure 11A:
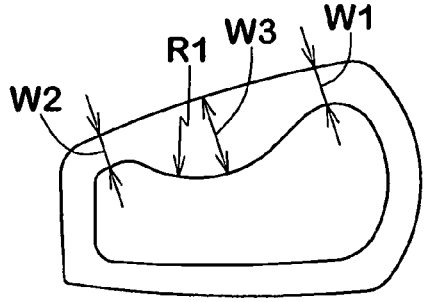
FIGS. 11A to 11E are schematic views showing an embodiment of the face plate.
Figure 11B:
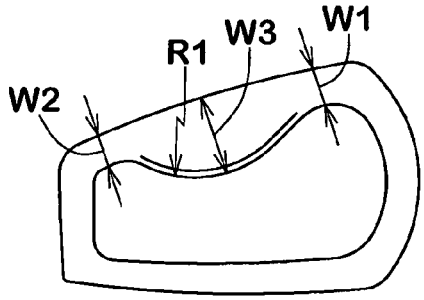
Figure 11C:
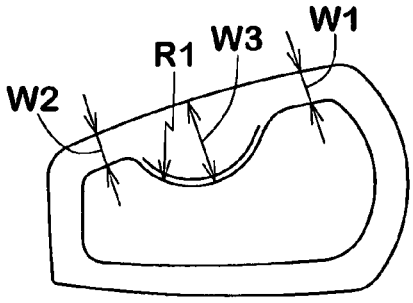
Figure 11D:
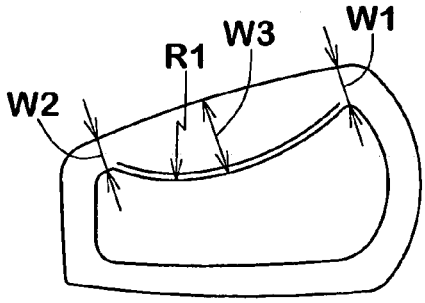
Figure 11E:
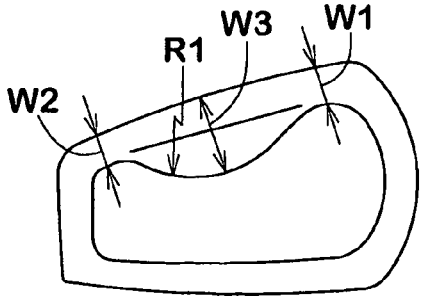

| | Comparative Example 1 | Embodiment 1 | Embodiment 2 | Embodiment 3 | Embodiment 4 | Embodiment 5 | Embodiment 6 |
|---|---|---|---|---|---|---|---|
| Shape of upper thin part | FIG. 13 | FIG. 11A | FIG. 11B | FIG. 11C | FIG. 11C | FIG. 11D | FIG. 11E |
| Widths of Upper Thin Part | | | | | | | |
| W1 [mm] | 4 | 4 | 4 | 4 | 4 | 4 | 4 |
| W2 [mm] | 4 | 4 | 4 | 4 | 4 | 4 | 4 |
| W3 [mm] | 4 | 8 | 10 | 12 | 12 | 12 | 10 |
| Radius of Curvature R1 [mm] of Arc Curve | — | 100 | 100 | 50 | 25 | 100 | 100 |
| Distance K1 [mm] | 15 | 8 | 8 | 7 | 7 | 8 | 8 |
| Distance K2 [mm] | 7 | 10 | 10 | 12 | 12 | 11 | 10 |
| Narrow Groove | Not Provided | Not Provided | | | Provided | | |
| Radius of Curvature [mm] of Narrow Groove | — | — | 101.6 | 50.8 | 25.4 | 381 | ∞ |
| Length [mm] of Narrow Groove | — | — | 42 | 38 | 27 | 48 | 30 |

TABLE 1-continued

| | | Comparative Example 1 | Embodiment 1 | Embodiment 2 | Embodiment 3 | Embodiment 4 | Embodiment 5 | Embodiment 6 |
|---|---|---|---|---|---|---|---|---|
| Test Results | Rebound Performance [index] | 100 | 100.2 | 101.2 | 101.7 | 101.5 | 100.7 | 100.4 |
| | Durability [mm] | 0.03 | 0.03 | 0.05 | 0.06 | 0.04 | 0.04 | 0.03 |
| | Impact at Time of Hitting Ball [kgf] | 1178 | 1120 | 920 | 842 | 887 | 973 | 1064 |
| | Hitting Feeling [1-5 scale] | 3.0 | 3.50 | 4.20 | 4.60 | 4.50 | 4.10 | 3.80 |

As a result of the test, it is confirmed that the club head of the embodiment significantly improves the rebound performance without reducing the durability. Further, with the structure in which the narrow groove is provided in the upper thin part, it is confirmed that the impact force is significantly absorbed. Further, in the actual feeling test by the golfers, an significant improvement of the ball hitting feeling is observed.

The invention claimed is:

1. An iron-type golf club head comprising a top having an upper surface of the club head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising at least upper thin part provided between the top and the thick part, the upper thin part having a width increasing from both sides of the toe and the heel toward therebetween, the upper thin part having an outer edge extending by the top and an inner edge extending along the thick part, and the inner edge includes an curve protruding toward the sole.

2. The iron-type golf club head according to claim 1, wherein the width of the upper thin part increases toward a center portion between the toe and the heel smoothly.

3. The iron-type golf club head according to claim 1, wherein the curve is formed by at least one arc.

4. The iron-type golf club head according to claim 3, wherein the arc has a radius of curvature in the range of from 25 mm to 100 mm.

5. The iron-type golf club head according to claim 1, wherein at least one narrow groove is provided on the upper thin part by the inner edge.

6. The iron-type golf club head according to claim 5, wherein the narrow groove has a width in the range of from 0.25 mm to 0.75 mm and a depth in the range of from 0.10 mm to 0.40 mm.

7. The iron-type golf club head according to claim 1, wherein the thin part surrounds the thick part continuously.

8. The iron-type golf club head according to claim 7, wherein the thin part comprises the upper thin part, a lower thin part provided between the sole and the thick part, a toe-side thin part connecting the upper thin part and the lower thin part at the toe side and a heel-side thin part connecting the upper thin part and the lower thin part at the heel side, and the toe-side thin part, the lower thin part and the heel-side thin part each has substantially the same width.

9. The iron-type golf club head according to claim 1, wherein the curve extends in a V-shape.

10. The iron-type golf club head according to claim 1, wherein the curve extends in a trapezoidal shape.

11. The iron-type golf club head according to claim 1, wherein the curve extends in a rectangular shape.

12. An iron-type golf club head comprising a top having an upper surface of the club head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising at least upper thin part provided between the top and the thick part, the upper thin part having a width increasing from both sides of the toe and the heel toward therebetween, wherein each ratio W3/W1 and W3/W2 of the respective widths is in a range of from 1.50 to 3.0, where W1: the smallest width in the toe side of the upper thin part, W2: the smallest width in the heel side of the upper thin part and W3: the largest width of an intermediate portion of the upper thin part.

13. An iron-type golf club head comprising a top having an upper surface of the club head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising an upper thin part provided between the top and the thick part, and a lower thin part provided between the sole and the thick part, the upper thin part having a width increasing from both sides of the toe and the heel toward therebetween, wherein in a vertical cross section of the club head passing through the sweet spot and being perpendicular to the face, a distance K1 parallel with the face between the sweet spot and the inner edge of the upper thin part is smaller than a distance K2 parallel with the face between the sweet spot and the inner edge of the lower thin part.

14. An iron-type golf club head comprising a top having an upper surface of the dub head, a sole having a bottom surface of the club head, a toe connecting between the top and the sole, a heel being in the opposite side of the toe, a face portion being surrounded by the top, the sole and the toe, the face portion comprising a thick part having an area including a sweet spot of the club head and a thin part provided around the thick part and having a thickness smaller than the thick part, the thin part comprising an upper thin part provided between the top and the thick past, wherein the width of the upper thin part changes so as to become larger from both sides of toe and heel to its intermediate portion so that the upper thin part is enlarged near the sweet spot.

* * * * *